US008690429B1

(12) United States Patent
Germanow et al.

(10) Patent No.: US 8,690,429 B1
(45) Date of Patent: Apr. 8, 2014

(54) LINER BAG FOR FEMININE HYGIENE WASTE RECEPTACLES

(75) Inventors: John W. Germanow, Pittsford, NY (US); Ann D. Germanow, Pittsford, NY (US)

(73) Assignee: The Scensible Source Co., LLC, Pittsford, NY (US)

( * ) Notice: Subject to any disclaimer, the term of this patent is extended or adjusted under 35 U.S.C. 154(b) by 1101 days.

(21) Appl. No.: 12/082,537

(22) Filed: Apr. 11, 2008

Related U.S. Application Data

(60) Provisional application No. 60/922,790, filed on Apr. 11, 2007.

(51) Int. Cl.

| | |
|---|---|
| ***B65D 33/06*** | (2006.01) |
| ***B65D 33/10*** | (2006.01) |
| ***B65D 33/14*** | (2006.01) |
| ***B65D 25/24*** | (2006.01) |
| ***B65D 25/14*** | (2006.01) |
| ***B65D 35/14*** | (2006.01) |
| ***B65D 90/00*** | (2006.01) |

(52) U.S. Cl.
USPC ..... 383/22; 383/6; 383/7; 383/24; 383/25; 383/29; 220/495.01; 220/495.05; 220/495.06; 220/495.08; 220/495.11

(58) Field of Classification Search
USPC ..... 383/1, 6, 7, 8, 9, 10, 12, 14, 21, 22, 24, 383/33, 66, 77, 25, 29, 26, 37; 220/495.07, 220/495.08, 495.1, 495.11, 495.01, 495.06, 220/476, 477, 478, 479, 480, 481, 482, 483, 220/908, 908.1; 4/300, 315, 340, 416, 484, 4/245.3, 245.5; 224/409; 248/95, 97, 99, 248/100, 318; 229/87.03, 87.04
See application file for complete search history.

(56) References Cited

U.S. PATENT DOCUMENTS 1,808,375 A * 6/1931 Plooster ..... 383/8
3,349,936 A * 10/1967 Morton et al. ..... 217/3 BC (Continued)

FOREIGN PATENT DOCUMENTS

EP 1013567 A1 * 6/2000 ..... B65F 1/06
WO WO2007/050928 5/2007

OTHER PUBLICATIONS

Sanitary Disposal Unit, Website printouts from www.sdunit.com (2004).

(Continued)

*Primary Examiner* — Jes F Pascua
*Assistant Examiner* — Nina Attel
(74) *Attorney, Agent, or Firm* — Kenneth J. Lukacher Law Group

(57) ABSTRACT

An improved receptacle liner bag is formed of two layers of thin flexible stretchable plastic sheets which are sealed along the sides and bottom, but are unsealed along the top of the bag. The sheets are die-cut to form a framed opening which defines a band between the sides and the top of the bag. When the bag is placed in the receptacle, the band may be disposed around the outside of the sides of the receptacle and stretched over the base of the receptacle so as to provide a hold-down for the bag in the receptacle. The sheets may be perforated along a line below the framed opening. The line, when opened, forms an auxiliary band which can be stretched over and placed behind a hinge of a lid of the receptacle to secure the back of the liner bag in the receptacle.

14 Claims, 9 Drawing Sheets

(56) References Cited

U.S. PATENT DOCUMENTS

| | | | | |
|---|---|---|---|---|
| 3,580,486 | A * | 5/1971 | Kugler | 383/8 |
| 3,774,838 | A * | 11/1973 | Christie | 383/77 |
| 3,822,806 | A * | 7/1974 | Grimes | 215/11.3 |
| 4,017,020 | A * | 4/1977 | Frank | 383/42 |
| 4,753,538 | A * | 6/1988 | Jorda | 383/8 |
| 4,867,339 | A * | 9/1989 | Hahn | 220/495.1 |
| 5,105,969 | A * | 4/1992 | Lamas | 229/117.35 |
| 5,155,871 | A * | 10/1992 | Sams | 4/484 |
| 5,261,553 | A * | 11/1993 | Mueller et al. | 220/495.1 |
| 5,394,834 | A * | 3/1995 | Queen et al. | 119/168 |
| 5,462,103 | A * | 10/1995 | Effa | 150/154 |
| 6,115,855 | A * | 9/2000 | Lorenzo | 4/484 |
| 6,123,215 | A * | 9/2000 | Windle | 220/495.07 |
| 6,375,131 | B1 * | 4/2002 | Youst | 248/101 |
| 6,398,411 | B2 * | 6/2002 | Metzger | 383/33 |
| 6,457,863 | B1 * | 10/2002 | Vassallo | 383/43 |
| 6,739,114 | B2 | 5/2004 | Shaffer | |
| 7,210,848 | B2 * | 5/2007 | Barbier et | 383/66 |
| D545,215 | S | 6/2007 | Germanow et al. | |
| 2002/0171014 | A1 * | 11/2002 | Russell et al. | 248/99 |
| 2003/0089719 | A1 * | 5/2003 | Berger | 220/495.07 |
| 2003/0136787 | A1 * | 7/2003 | Singuillo | 220/495.1 |
| 2005/0069227 | A1 * | 3/2005 | Steele | 383/7 |
| 2006/0163257 | A1 * | 7/2006 | Golbert | 220/495.07 |
| 2007/0116384 | A1 * | 5/2007 | Mason | 383/9 |
| 2007/0163038 | A1 * | 7/2007 | Sharp | 4/484 |
| 2007/0189643 | A1 * | 8/2007 | Tresenfeld | 383/105 |
| 2008/0154221 | A1 * | 6/2008 | Thornton | 604/358 |

OTHER PUBLICATIONS

Ruffles Retail Trash Bags, Covalence Plastics Co. Web page at http://www.covalenceplastics.com/site/content/retail/retail.asp (2006).

Intima & Intima Mini, Kennedy Hygiene Products Ltd., printout from http://www.kennedy-hygiene.co.uk/productrange/femininehygiene/intima.html (2004).

6140 Sanitary Napkin Recepticle, Rubbermaid Commercial Products, printout from http://www.rcpworksmarter.com/rcp/products/detail.jsp?categoryCode=cleaning&subCategoryCode=cleaning_washroom&rcpNum=6140 (2008).

Health Gards® Liners, Hospeco, Printout from http://www.hospeco.com/instit/liners.asp, dated Aug. 20, 2008.

Disposal Units & Liners, Rochester Midland Corporation, Printout from http://www.rochestermidland.com/division/perscare/feminine/units_and_liners.htm (2000).

Intima, Product Specification Sheet, Kennedy Hygiene Products, Ltd. ( 2004).

* cited by examiner

LINER BAG FOR FEMININE HYGIENE WASTE RECEPTACLES

Priority is claimed to U.S. Provisional Patent Application No. 60/922,790, filed Apr. 11, 2007, which is herein incorporated by reference.

FIELD OF THE INVENTION

The present invention relates to apparatus (and method) for the sanitary disposal of feminine hygiene products after use thereof, and particularly to a liner bag for feminine hygiene waste receptacles which receive such products.

BACKGROUND OF THE INVENTION

Women's restrooms are equipped with waste receptacles for sanitary napkins and other feminine hygiene products. These receptacles are boxes of metal or plastic having a lid provided by a cover. The back of the receptacle is attached to a wall of the stall. The lid is hinged to the back wall of the receptacle. Sides of the lid may form a skirt which extends over the top of the receptacle and the front and the sides thereof. These receptacles receive a bag therein and may be called surface mounted sanitary napkin disposal units.

Heretofore waxed bags, which may be of waxed paper, were inserted into the receptacle. These bags are prone to being pushed down into the receptacle as the bags are filled with the feminine hygiene products. The sides of the bag may become displaced from the insides of the receptacle or may be pushed down into the receptacle. When this occurs, the feminine products may fall between the outside of the bag and the inside walls of the receptacle, or are placed against the unprotected walls of the receptacle. This creates unsanitary conditions, since the waxed paper bag, when pushed down into the receptacle or away from the walls thereof, loses its effectiveness as a sanitary container.

SUMMARY OF THE INVENTION

Accordingly, it is an object of the present invention to provide an improved apparatus and method which facilitates the disposal of sanitary products, such as sanitary napkins and other feminine hygiene products.

It is another object of the present invention to provide liner bags which fit within a receptacle and are secured alongside the inner walls thereof to prevent the sanitary products which are inserted therein from falling between the inner walls of the receptacle and the bag.

It is a further object of the present invention to provide an improved liner bag for feminine hygiene waste receptacles, which when installed in the receptacle define a stretchable wrapping band which loops around the receptacle over the base thereof to hold the bag securely in the receptacle.

It is a still further object of the present invention to provide a liner bag for feminine hygiene waste receptacles having a lid where the bag forms an auxiliary band which extends over the lid and against an area, where the lid joins and may be hinged to a back wall of the receptacle for securing the bag against the inside back wall of the receptacle.

Briefly described, the invention provides an improved receptacle liner bag, especially suitable for surface mounted sanitary napkin disposal units. The bag is formed of two layers of thin flexible, stretchable plastic sheets which are sealed along the sides and bottom, but are unsealed along the top of the bag. The sheets are die-cut to form a framed opening which defines a band between the sides and the top of the bag. Since the bag is made of flexible stretchable plastic material, the band along the sides and top of the framed opening can be stretched around the receptacle. Accordingly, when the bag is placed in the receptacle, the band may be disposed around the outside of the sides of the receptacle and stretched over the base of the receptacle so as to provide a hold-down for the bag in the receptacle. The bag may not only line the receptacle, but also provide a flap or skirt which extends over the side and front walls of the receptacle. The flap and the hold-down prevent any used feminine hygiene product which may be placed into the bag from pushing the bag away from the insides of the walls of the receptacle and enter between the receptacle and the bag. The liner bag is therefore an efficient and effective sanitary napkin and other feminine hygiene product disposal device.

In a preferred embodiment of the invention, the sheets are slit along a line below the bottom of the frame forming opening. This slit may be provided by a line of perforations. The slit defines an auxiliary band between the bottom of the opening and the line of perforations. This auxiliary band is placed behind the lid of the receptacle by passing the lid through the slit, provided by the perforations. This band is stretchable to secure the bag against the back wall of the receptacle which is mounted on the wall of the stall or toilet room.

The invention also provides a method for installing a liner bag in a receptacle having the steps of: providing a bag of flexible material having a first end which is closed and a second end having an opening that forms a band; locating the bag in a receptacle having a bottom, and stretching the band to loop around the bottom exterior of the receptacle to retain the bag upright in the receptacle. The locating step may extend flaps over the rim of the receptacle, in which the bag provides such flaps along the bottom of the opening that forms the band. The method may further have the step of locating a second band around the lid of the receptacle, in which the bag has another opening at its first end providing such second band.

The foregoing and other objects features and advantages of the invention as well as a presently preferred embodiment thereof will become apparent from the accompanying drawings.

DETAILED DESCRIPTION OF THE INVENTION

Figure 1:
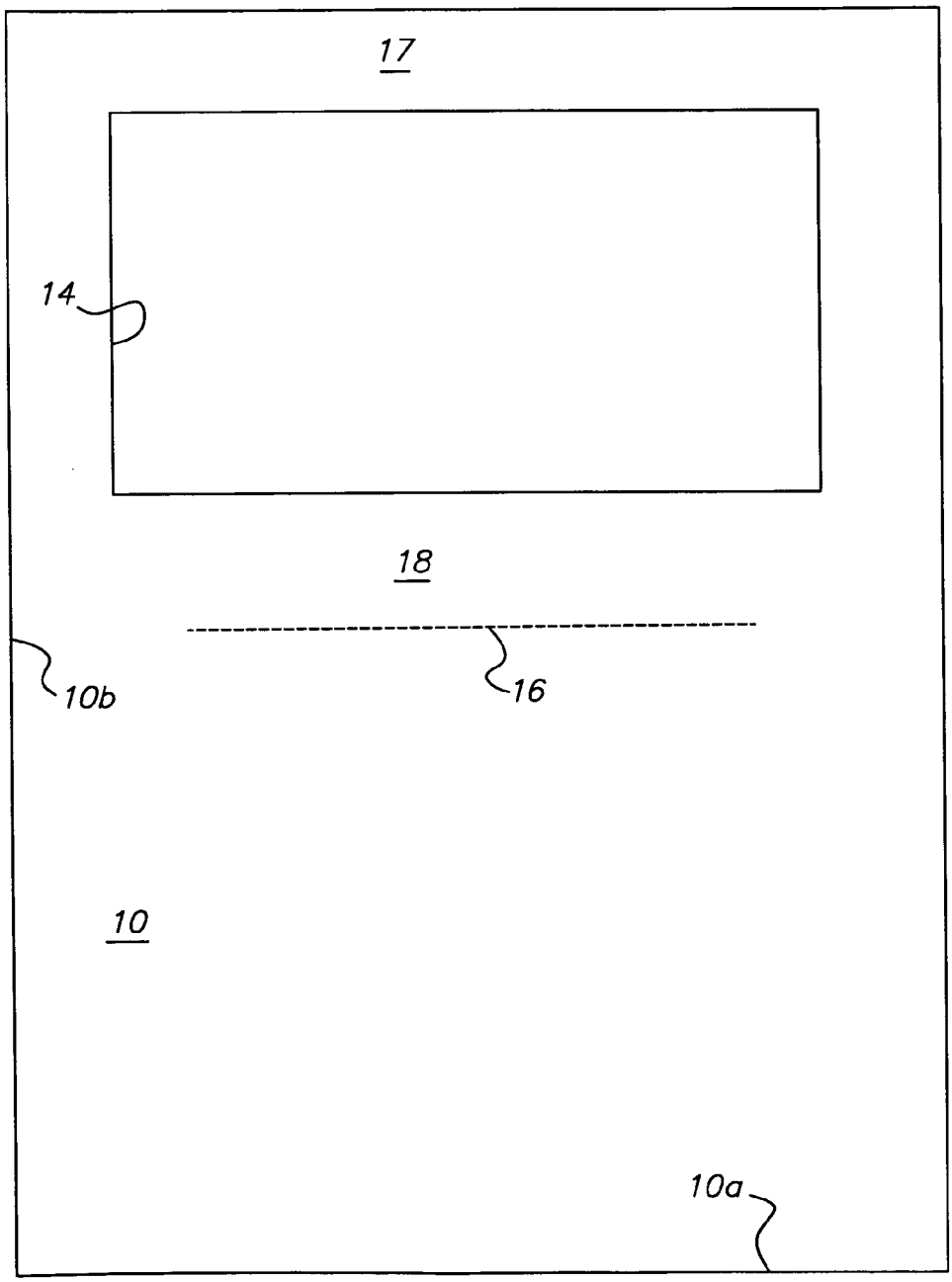
FIG. 1 is a plan view of a liner bag provided in accordance with the invention which is especially adapted to provide a disposable bag into which used feminine hygiene products are received when the bag is inserted into a receptacle, and especially a receptacle of a surface mounted sanitary napkin disposal unit.
Figure 2A:
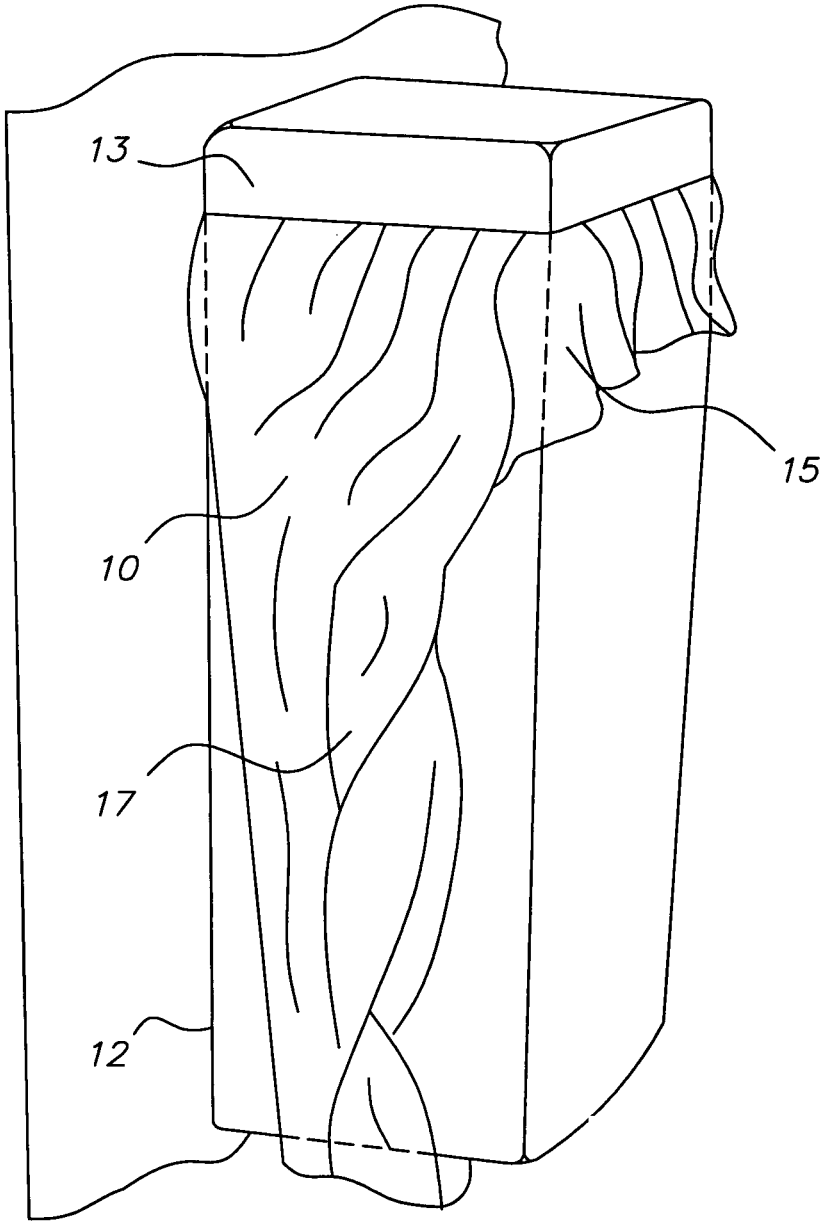
FIGS. 2A, 2B, 2C, and 2D are respectively perspective views from the left side, the right side, the back (with the lid of the receptacle closed), and from the bottom of a surface mounted disposal unit wherein the liner bag provided in accordance with the invention is installed into the receptacle of the surface mounted unit.
Figure 2B:
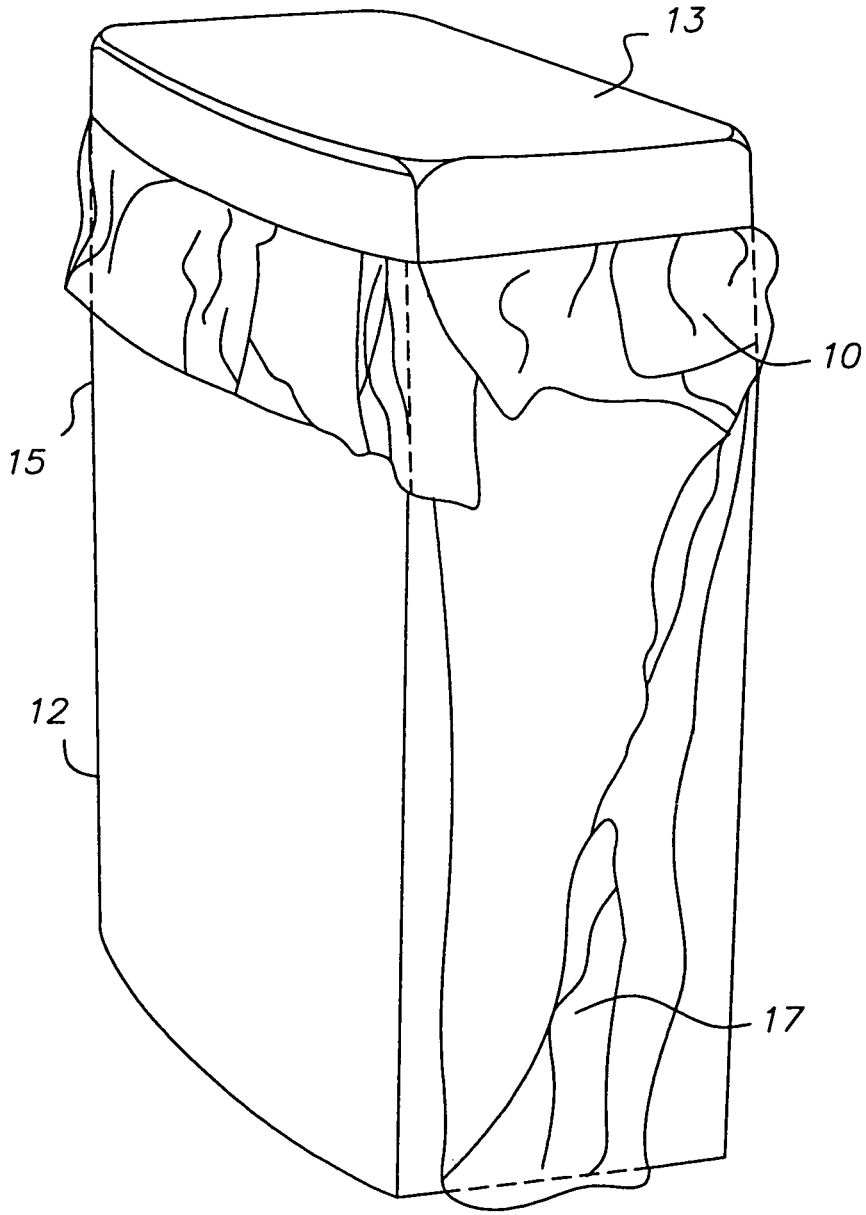
Figure 2D:
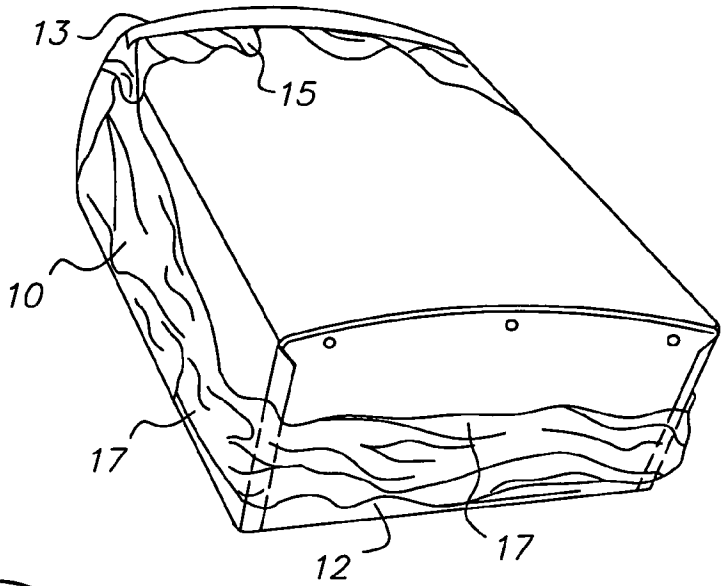
Figure 2C:
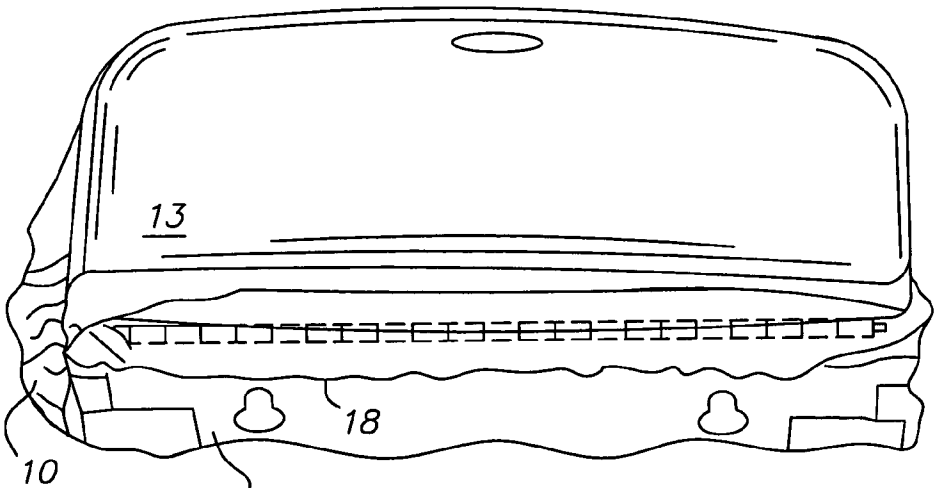
Figure 2F:
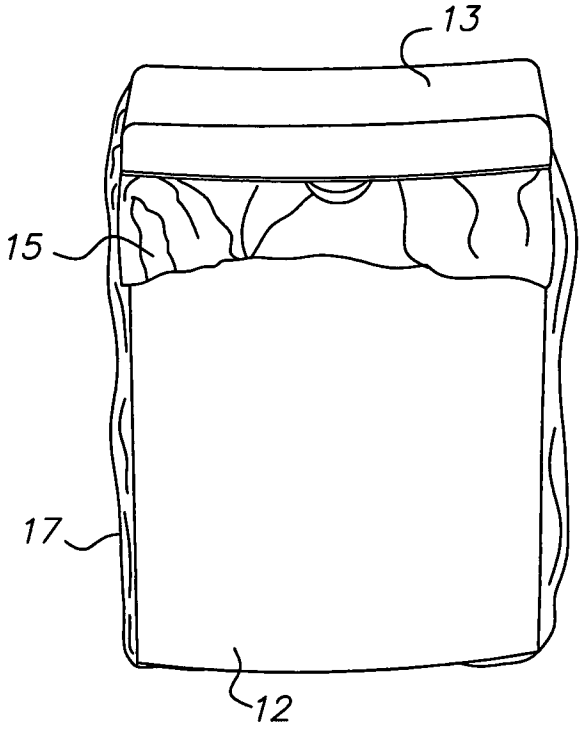
FIG. 2F is a perspective view from the front showing the bag installed in the receptacle with the lid closed.
Figure 2E:
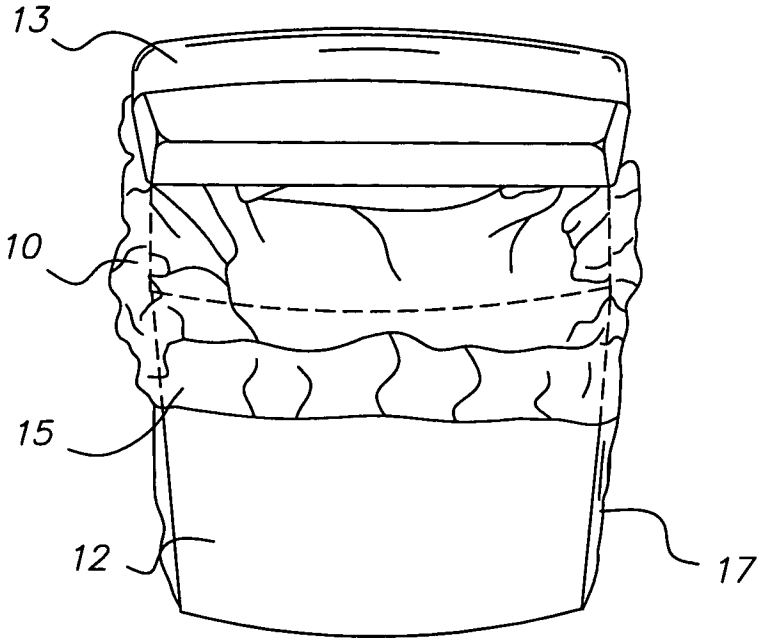
FIG. 2E is a perspective view from the front with the lid open showing the bag installed in the receptacle.

Referring to the drawing, the bag (10) itself is a plastic bag (see FIG. 1) preferably of low density, 1 mil. thick low density polyethylene material. Bag (10) is formed of two layers of thin flexible stretchable plastic sheets which are sealed along the sides and bottom to provide a closed end (10*a*), and unsealed along a length of a top end (10*b*). The bag is long enough to fill the receptacle (12) to the bottom thereof. The bag (10) is, by virtue of the material thereof flexible and stretchable, facilitates insertion thereof into the receptacle with a flap (15) or skirt extending around the top of the receptacle (see FIGS. 2 A-D). In order to form the band (17) which holds the bag (10) inside the receptacle and also to form the flap, the bag is made longer than the side walls of the receptacle. For example, the receptacle may be 10" in height above the base and have an opening 8" long and 4" wide. In other words, the depth of the receptacle, from the front wall to the back wall thereof which is mounted on the wall of the stall, is 4", approximately. The bag is provided (by die-cutting the sheets forming such bag) with a die-cut opening (14) providing a frame which forms the band (17) around the sides and top of the opening. The top of the opening is the top of the band. The opening is of a size sufficient to leave an area for the flap below the bottom of the opening. For example, for a 10" high receptacle, the frame around the sides and top of the opening may be an inch and a half in width and the bottom of the opening may be 14" above the bottom of the bag. This leaves an area sufficient to form the flap.

Figure 4A:
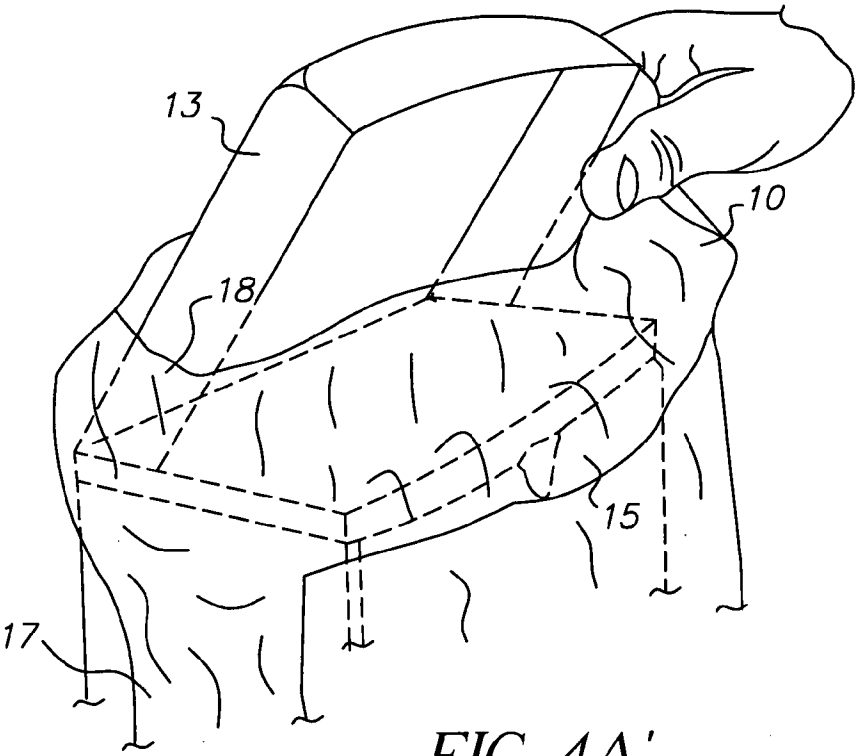
FIGS. 4A, 4A', 4B, 4B', 4C, and 4D are perspective views showing the liner bag provided by the invention in the process of installation into a receptacle and showing the auxiliary band formed when the liner perforations are opened to provide a slit, installed partially across the lid and the loop of the band which stretches around the sides and over the bottom of the receptacle lying across the sides and face of the receptacle, FIGS. 4A and A' being taken from the left side, FIGS. 4B and 4B' being taken from the right side, FIG. 4C being taken from the back with the lid being pivoted on the hinge, which attaches the lid to the back of the receptacle, in a partially open position to show the auxiliary band being stretched across the lid toward the joint formed by the hinge, and with FIG. 4D being taken from the front of the receptacle with the lid opened and the auxiliary band being pushed over the lid.
Figure 4A:
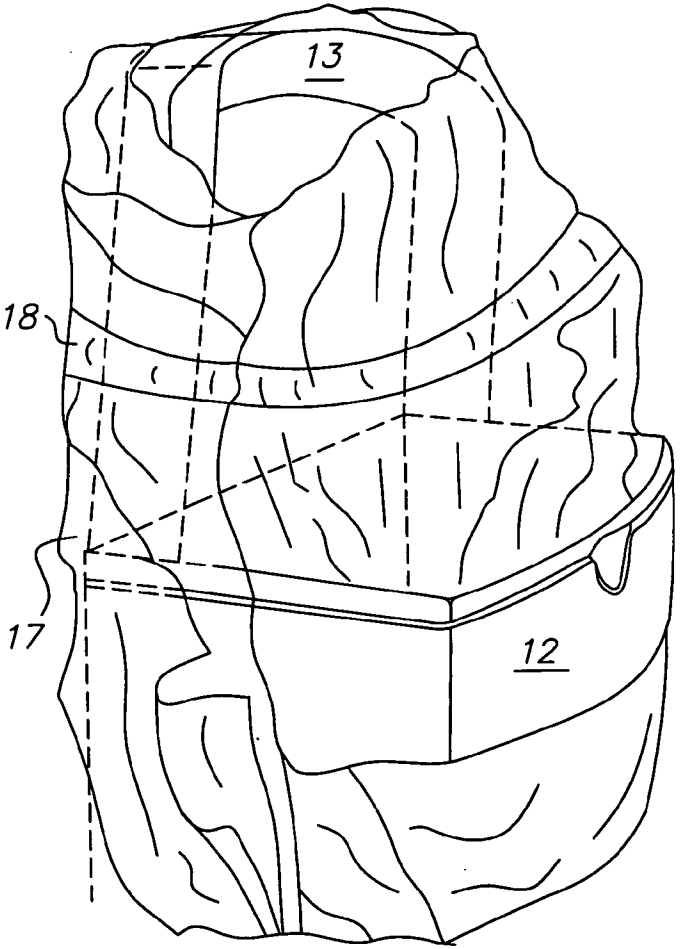
Figure 4B:
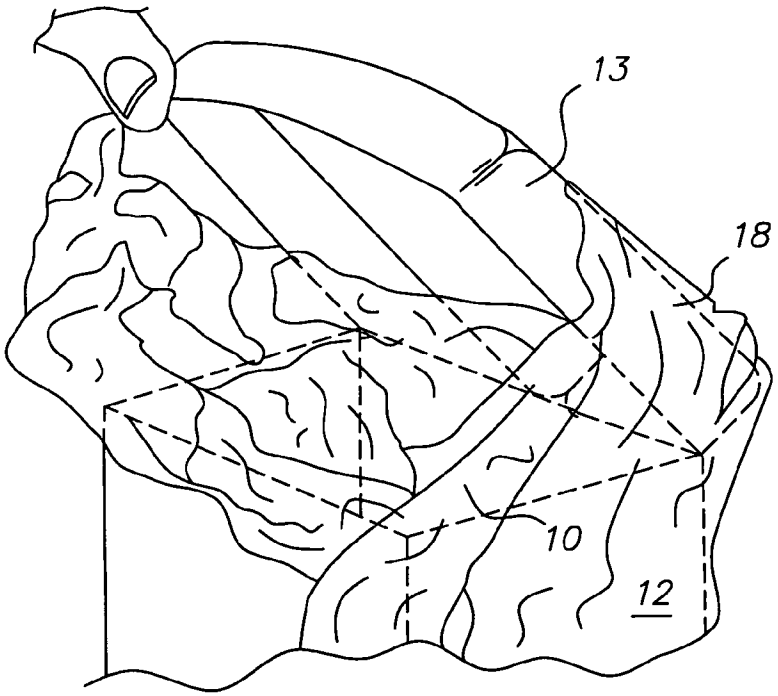
Figure 4B:
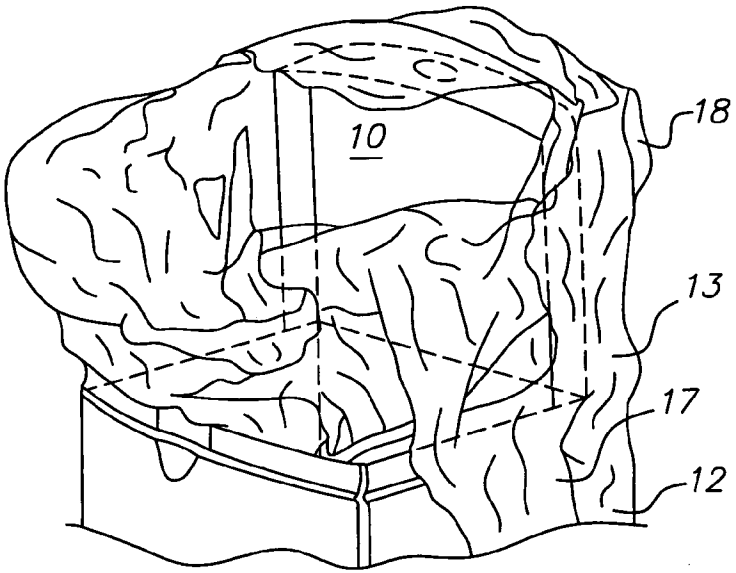
Figure 4C:
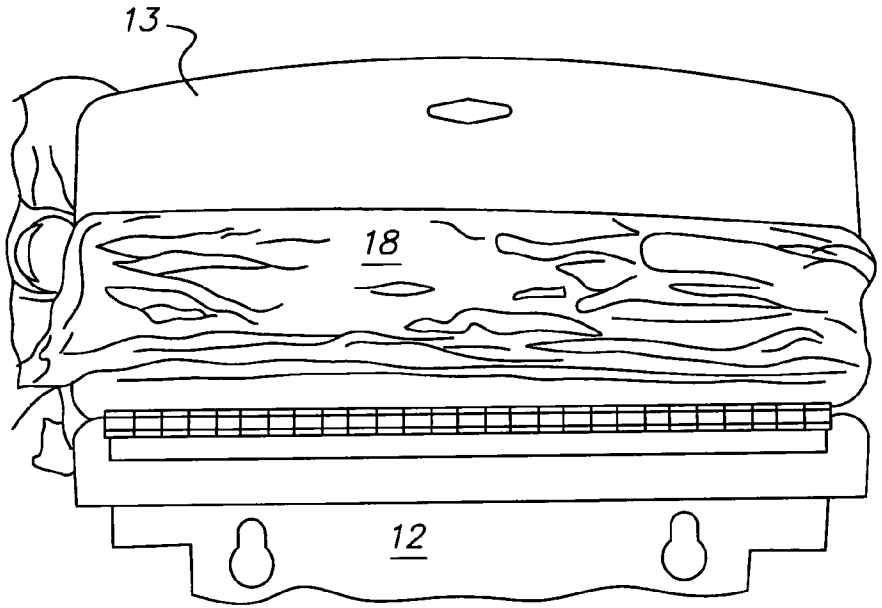
Figure 4D:
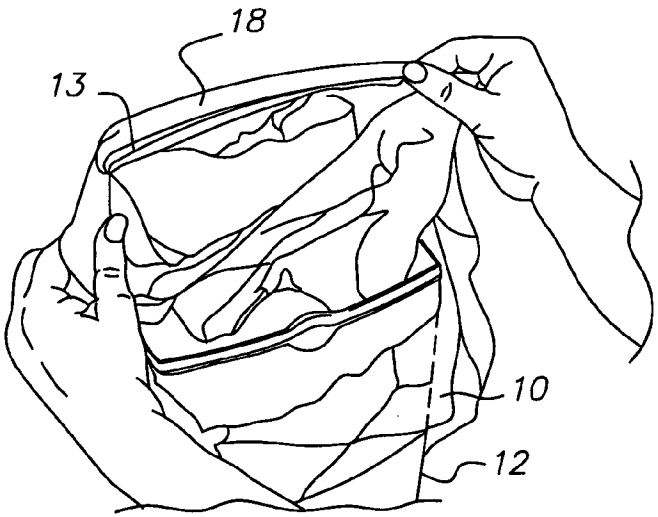

In order to form an auxiliary band (18), which extends over and behind the lid (13) of the receptacle (12) and secures the back of the inserted bag (10) inside the receptacle and further eliminates any space between the edge of the back of the bag and the inside back wall of the receptacle, a slit is formed by a line of perforations (16). This slit defines, between the bottom of the opening (14) and the line (16), an auxiliary band (18). This auxiliary band (18) is formed when the perforations are opened to provide the slit upon insertion of the band (18) onto the lid (13) of the receptacle (12) as best shown in FIGS. 4A, B, C and D. The use of this auxiliary band (18) is preferred but is optional. The slit formed by the line of perforations (16) and the auxiliary band (18) formed when the perforations are opened to provide the slit upon insertion of the band (18) into the lid (13) of the receptacle (12) provides means for extending another band from one of the ends which loops around the lid.

Figure 3A:
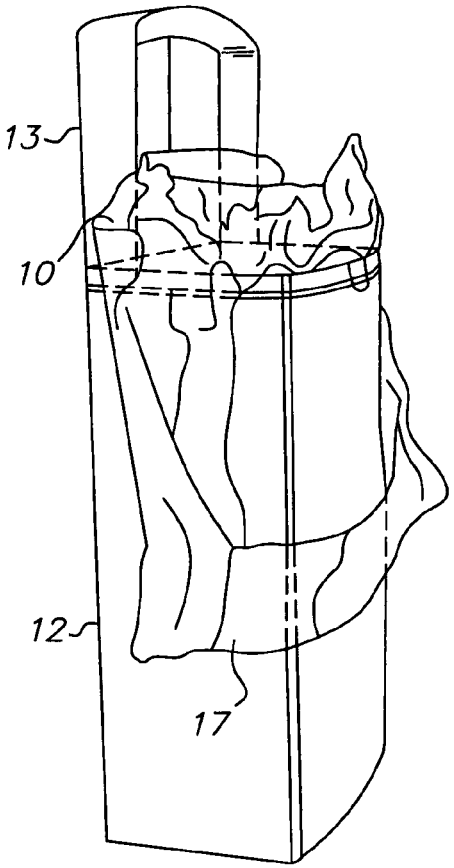
FIGS. 3A and 3B are perspective views of the surface mounted unit receptacle with the liner bag provided by the invention in process of being installed, and specifically at the stage where the bag is partially inserted into the receptacle of the unit, FIG. 3A being from the left side and FIG. 3B from the right side of the unit respectively.
Figure 3B:
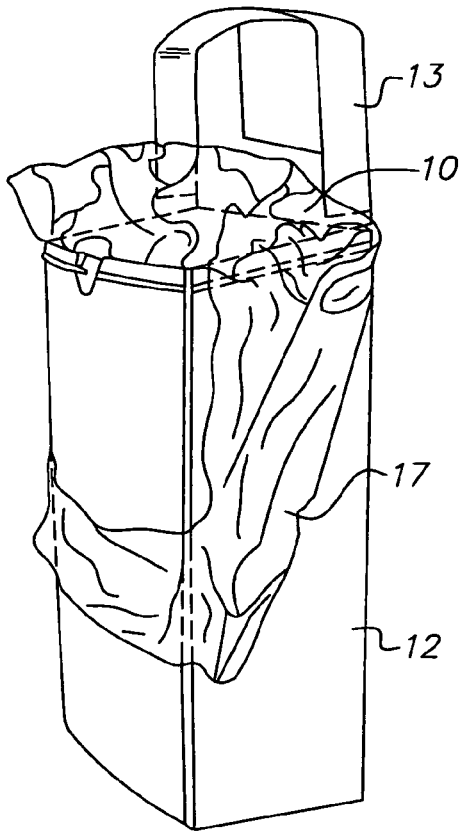

When the bag (10) is inserted into the receptacle (see FIGS. 3 and 4), the backside of the flap bears against the inside back wall of the housing. The band (17) which is formed along the outsides of the opening and along the top of the opening, which may, in the above example, be approximately 1½" in width and can be extended over the top edge of the receptacle while the flap is formed over the front wall and the side walls of the receptacle. The band (17) is long enough to be brought around the sides of the receptacle (12) and loops around the base of the receptacle. The length of the band (17) is approximately the same as the length of the receptacle so that it can stretch and provide a tight fit, thereby retaining the bag and its flaps in the receptacle. The flexible, stretchable material of the bag (10) allows the band (17) to be stretched along the outside, side walls of the receptacle (12) and to loop around and bear against the base of the receptacle. As the bag (10) is filled with sanitary napkin and other feminine hygiene product waste, the bag thus maintains its installed position (e.g., upright) in the receptacle (12). Accordingly, the bag (10) opening and the configuration and size of the band (17) formed by the opening in the bag provide means for extending the band from one of the ends of the bag which is configured and sized with respect to the receptacle to loop around and bear entirely against the bottom exterior of the receptacle to retain position of the bag with respect to the receptacle when the other of the ends of the bag is located in the receptacle.

Preferably, the plastic material of the bag (10) includes bio-degradable plastic additive which enables the bag to bio-degrade when disposed of in a sanitary landfill.

Preferably, the bag material contains an antimicrobial agent which inhibits the growth of odor causing bacteria.

The bag material may contain fragrance materials to mask odors and can also provide a fresh floral smell. The bag (10) may be made with or without bio-degradable plastic additive and with or without antimicrobial or fragrance agents.

Another feature of the invention is that the band (17) and auxiliary band (18) facilitate the removal of the bag (10) after it is full, so that the bag may be disposed of together with the used feminine hygiene products contained therein. The band (17) may be slipped off the bottom of the receptacle (12) and the auxiliary band (18), if present, may be slipped off around the lid (13). Then the bag (10) may be lifted out of the receptacle (12) with the aid of the band (17) and the auxiliary band (18). The band (17) may be tied into a knot, or with a tie, to close the bag (10) and prevent the used feminine hygiene products from falling out of the bag after it is removed from the receptacle (12). Thus, the band (17) is configured and sized to provide means which utilizes the band to close and retain contained waste in the bag when the bag is removed from the receptacle (12).

From the foregoing description, it will be apparent that an improved receptacle liner bag and method for using such bag has been provided. Variations and modifications of the herein described receptacle liner bag and other applications for the invention will undoubtedly suggest themselves to those skilled in the art. Accordingly, the foregoing description should be taken as illustrative and not in a limiting sense.

The invention claimed is:

1. A liner bag for a receptacle of a sanitary napkin disposal unit, said receptacle having an open top and a closed bottom, said liner bag comprising two layers of flexible or stretchable thin material which are sealed along side and bottom edges, an opening through both of said layers and spaced from said side edges and a top edge of said layers defining a frame, said frame forming a band along said top edge which contains both said two layers, said band being configured to loop around sides of the receptacle and across the closed bottom thereof to hold in the receptacle as a liner, the bag formed when said layers are separated, said bag further comprising a slit through both of the layers between the side edges and spaced from a bottom of the opening, defining an auxiliary band in each of said layers and disposed along the bottom of the opening, said auxiliary band being configured to be slidable over a cover of said receptacle which is hinged to a side thereof which is attachable to the wall of a restroom stall or wall so as to secure a back of the liner bag against an inside back wall of the receptacle.

2. The liner bag according to claim 1 wherein said opening along the bottom thereof is of sufficient length from a bottom end of the bag to define, when said sheets are separated to provide the liner bag in the receptacle, flaps which extend over said receptacle away from a rim along an edge of the open top of the receptacle.

3. The liner bag according to claim 1 wherein the band configured to loop is sufficiently long to be knotted upon removal from the receptacle filled with sanitary napkins retained therein.

4. The liner bag according to claim 1 wherein said bag is of biodegradable material.

5. The liner bag according to claim 1 wherein said bag is of material having an antimicrobial agent.

6. The liner bag according to claim 1 wherein said bag is of scented material.

7. The liner bag according to claim 1 wherein said band which loops around the receptacle extends across a widest side of said bag and is long enough and wide enough to stretch over the sides of said receptacle and across a width thereof at the bottom thereof.

8. The liner bag according to claim 7 wherein said band which loops around the receptacle consists of a single band of both of said layers.

9. The liner bag according to claim 1 wherein said auxiliary band is provided in one of said layers by a line of perforations which is opened to form said slit.

10. A method for installing a liner bag in a receptacle with an open top and a bottom comprising the steps of:

providing a bag with two layers of thin, flexible, stretchable material having a first end which is closed and a second end having an opening that forms with both said layers a continuous elastic band extending across said second end entirely and of sufficient length when extended to loop around the receptacle and stretch across the bottom thereof;

separating said layers to form said bag in the receptacle above the bottom thereof; and stretching both layers of said band to loop over an outside of the receptacle and around the bottom of said receptacle to apply compressive force against the receptacle and retain said bag upright in the receptacle; and further comprising the step of providing an auxiliary band, by opening a slit through both of said layers, said slit being spaced into said bag from the opening that forms said band and forming the auxiliary band in at least one of said layers, and locating said auxiliary band in one of said layers around a lid of the receptacle.

11. The method according to claim 10 wherein the receptacle has a rim, and said method further comprises extending said layers over said rim while separating said layers so that said bag provides flaps along a bottom of said opening, and said locating step further comprises extending the flaps over the rim of the receptacle.

12. The method according to claim 10 wherein said bag is of material which is one or more of biodegradable, antimicrobial, or scented.

13. The method for installing a liner bag according to claim 10 wherein said step of providing said slit forming the auxiliary band comprises opening lines of perforations.

14. An apparatus for lining a receptacle having a bottom comprising:

a bag having two ends provided by a pair of layers of thin, flexible, stretchable material which are separated to form the bag, and a band made up of both of said pair of layers from one of said ends of the bag which band is configured and sized with respect to the receptacle to loop around and bear entirely against a bottom exterior of the receptacle to retain and position in the receptacle the bag formed when said layers are separated inside the receptacle with the other of said ends located in the receptacle, and wherein said receptacle has a hinged lid, and said apparatus further comprises another, auxiliary band which is spaced into said bag further from said one end than said band which loops around the receptacle, and means for extending said another auxiliary band around said lid so that said lid captures said bag by said another band, and said another band being provided by lines of perforations through said layers when said perforations are opened.

* * * * *